US010738967B2

(12) United States Patent
Cao et al.

(10) Patent No.: US 10,738,967 B2
(45) Date of Patent: Aug. 11, 2020

(54) VENUE LIGHT INCLUDING VARIABLE LED ARRAY SIZE ETCHED LENS AND SEGMENTED REFLECTOR

(71) Applicant: Sportsbeams Lighting, Inc., Round Rock, TX (US)

(72) Inventors: Wei Cao, Round Rock, TX (US); Kevin C. Baxter, Henderson, NV (US); Min Shi, Round Rock, TX (US); Fred H. Holmes, Clearwater, FL (US)

(73) Assignee: SPORTSBEAMS LIGHTING, INC., Plano, TX (US)

( * ) Notice: Subject to any disclaimer, the term of this patent is extended or adjusted under 35 U.S.C. 154(b) by 0 days.

(21) Appl. No.: 16/405,914

(22) Filed: May 7, 2019

(65) Prior Publication Data

US 2019/0338913 A1 Nov. 7, 2019

Related U.S. Application Data

(60) Provisional application No. 62/668,043, filed on May 7, 2018, provisional application No. 62/719,508, filed on Aug. 17, 2018.

(51) Int. Cl.
*F21V 3/06* (2018.01)
*F21V 7/04* (2006.01)
(Continued)

(52) U.S. Cl.
CPC ..... *F21V 3/0615* (2018.02); *F21V 3/02* (2013.01); *F21V 3/049* (2013.01); *F21V 7/048* (2013.01);
(Continued)

(58) Field of Classification Search
CPC ..... F21V 3/0615; F21V 7/048; F21V 3/02; F21V 31/005; F21V 17/08; F21V 3/049;
(Continued)

(56) References Cited

U.S. PATENT DOCUMENTS 5,036,248 A 7/1991 McEwan et al.
6,241,366 B1 6/2001 Roman et al.
(Continued)

FOREIGN PATENT DOCUMENTS

CN 101142435 A 3/2008
CN 102606945 A 7/2012
(Continued)

*Primary Examiner* — Kevin Quarterman
(74) *Attorney, Agent, or Firm* — Scott R. Zingerman

(57) ABSTRACT

The disclosure of the present invention includes light fixtures having variable LED array sizes to form different beam angles. These light fixtures are particularly suitable for sports/venue lights and are characterized by highly concentrated high power small LED light sources including small light sources of different size LED arrays which may include additional diffusion. The present disclosure also includes a lens which substantially dissipates light to reduce if not eliminate glare. The lens may be pressed, chemically etched (pickled), or sandblasted to become a micro-lens. The lens may, alternately, be a plastic material. A further aspect of the present disclosure is the incorporation of a segmented reflector to greatly reduce glare. A single reflector may be segmented in its circumference or may be formed of multiple individual segments.

10 Claims, 5 Drawing Sheets

(51) Int. Cl.

| | |
|---|---|
| ***F21V 3/02*** | (2006.01) |
| ***F21V 31/00*** | (2006.01) |
| ***F21V 17/08*** | (2006.01) |
| ***F21V 3/04*** | (2018.01) |
| *F21Y 115/10* | (2016.01) |
| *F21W 131/105* | (2006.01) |

(52) U.S. Cl.
CPC ..... *F21V 17/08* (2013.01); *F21V 31/005* (2013.01); *F21W 2131/105* (2013.01); *F21Y 2115/10* (2016.08)

(58) Field of Classification Search
CPC ..... F21V 7/04; F21V 23/008; F21Y 2115/10; F21Y 2105/18; F21W 2131/105
See application file for complete search history.

(56) References Cited

U.S. PATENT DOCUMENTS

| | | | |
|---|---|---|---|
| 6,796,690 | B2 | 9/2004 | Bohlander |
| 7,244,048 | B2 | 7/2007 | Poggi |
| 7,600,892 | B2 | 10/2009 | Belliveau et al. |
| 7,629,570 | B2 | 12/2009 | Mondloch et al. |
| 8,662,702 | B2 | 3/2014 | Datz et al. |
| 8,702,255 | B2 | 4/2014 | Baxter et al. |
| 8,888,319 | B2 | 11/2014 | Lee et al. |
| 2003/0179584 | A1 | 9/2003 | Pond et al. |
| 2005/0111234 | A1 | 5/2005 | Martin et al. |
| 2006/0083017 | A1 | 4/2006 | Wang et al. |
| 2007/0139921 | A1 | 6/2007 | Wu |
| 2008/0212333 | A1 | 9/2008 | Chen |
| 2009/0237937 | A1 | 9/2009 | Liu |
| 2010/0242519 | A1 | 9/2010 | Breidenassel et al. |
| 2011/0013401 | A1 | 1/2011 | Gordin et al. |
| 2011/0043120 | A1 | 2/2011 | Panagotacos et al. |
| 2011/0182065 | A1* | 7/2011 | Negley ..... F21V 5/04 362/231 |
| 2011/0193467 | A1* | 8/2011 | Grajcar ..... F21V 31/005 313/113 |
| 2011/0267821 | A1* | 11/2011 | Van De Ven ..... F21V 29/004 362/249.02 |
| 2012/0092870 | A1 | 4/2012 | Tralli et al. |
| 2012/0236572 | A1* | 9/2012 | Negley ..... G02B 1/041 362/311.02 |
| 2013/0223064 | A1 | 8/2013 | Lee et al. |
| 2014/0022780 | A1 | 1/2014 | Roberge et al. |
| 2014/0043810 | A1 | 2/2014 | Jo et al. |
| 2014/0092593 | A1 | 4/2014 | Gordin et al. |
| 2014/0119019 | A1 | 5/2014 | Hsu |
| 2015/0264765 | A1 | 9/2015 | Gerszberg |
| 2016/0286629 | A1 | 9/2016 | Chen et al. |
| 2017/0245349 | A1 | 8/2017 | Van Der Brug |
| 2017/0257925 | A1 | 9/2017 | Forbis et al. |
| 2018/0020346 | A1 | 1/2018 | Li |

FOREIGN PATENT DOCUMENTS

| | | | |
|---|---|---|---|
| CN | 102606945 | B | 11/2013 |
| CN | 103492787 | A | 1/2014 |
| JP | 2002-043074 | | 2/2002 |
| JP | 2011-505702 | | 2/2011 |
| JP | 2011-090854 | A | 5/2011 |
| JP | 2012-094316 | | 5/2012 |
| JP | 2012-531703 | | 12/2012 |
| TW | 200535372 | A | 11/2005 |
| TW | M448605 | U | 3/2013 |
| WO | 2009071110 | A1 | 6/2009 |
| WO | 2010058326 | | 5/2010 |
| WO | 2010150170 | A1 | 12/2010 |
| WO | 2012099391 | A2 | 7/2012 |
| WO | 2014021087 | A1 | 2/2014 |

* cited by examiner

VENUE LIGHT INCLUDING VARIABLE LED ARRAY SIZE ETCHED LENS AND SEGMENTED REFLECTOR

CROSS REFERENCE TO RELATED APPLICATION

This application claims the benefit of U.S. Provisional Application No. 62/668,043 filed May 7, 2018 entitled "VENUE LIGHT INCLUDING VARIABLE LED ARRAY SIZE ETCHED LENS AND SEGMENTED REFLECTOR", and U.S. Provisional Application No. 62/719,508 filed on Aug. 17, 2018 entitled "SPORTS LIGHT HAVING SINGLE MULTI-FUNCTION BODY" both herein incorporated by reference in their entirety for all purposes.

INCORPORATION BY REFERENCE

Applicant incorporates fully herein by reference U.S. application Ser. No. 15/135,864 filed on Apr. 22, 2016 entitled LED VENUE LIGHTING SYSTEM AND METHOD, and U.S. Ser. No. 15/668,872 filed on Aug. 4, 2017 entitled LED BASED SEARCHLIGHT/SKY LIGHT.

FIELD OF THE INVENTION

This invention relates to LED lighting fixtures used for lighting venues and sports facilities.

BACKGROUND OF THE INVENTION

With all of their inherent advantages, including immediate strike ability, efficiency, dimmability and many others, LED fixtures have become very common in many applications. LED Light fixtures for use in sports venue/stadium lighting generally have an LED array which is adapted to project light onto the sports venue. These LED fixtures differ from some high bay lighting that might have a roughly similar appearance in that the sports lighting fixtures have a beam angle less than 70 degrees and sometimes as little as 10 degrees. These fixtures are more powerful than other types of fixtures because they are designed to cover large areas with a high light level. These sports light fixtures have support mechanism that allows for very fine control of the aiming as well as compatibility with standard sports lighting poles, cross arms, and platforms. These fixtures differ from fixtures employed in other industries/applications because they must have a very long maintenance-free life because they are commonly very inaccessible when mounted to the top of a 125' tall light pole. Maintenance at this height becomes very expensive.

The sporting community, however, has been much slower to adopt LED technology. Many sports lighting fixtures can look acceptable when you are standing behind it. However, when you're the athlete searching the night sky for a pop fly or a fan looking across the pitch, it has been found to be different. A major factor in this is the problem of glare. Most new LED sports lighting fixtures are bright enough, but the light quality eliminates them from serious consideration due to the hotspots and glare which has been found to obscure the vision of the spectator and/or competitor. LED Technology's inherent energy savings has been recognized for years. As the technology has matured, those savings have only increased along with the lumen output per watt. At the same time, however, there is a growing concern that the glare caused by the drive for increasing efficiency is making these lights less suitable for sporting venues.

A need exists to reduce or eliminate glare. Glare is excessive and uncontrolled brightness. It is caused by the luminous intensity per unit area of light travelling in a given direction. This can cause visual discomfort and reduced visibility. Fans and players have become very familiar with the uncomfortable sensation. Glare is occurring with greater frequency, especially in sports venues, as manufacturers are doing everything they can to push as much light as possible out of a fixture. They accomplish this by utilizing higher efficiency LEDs and forcing light from those LEDs through small, individual TIR lenses and reflectors. The lenses concentrate the light for better delivery, but inevitably create unacceptable levels of glare. Intense light is forced through hundreds of plastic lenses. Without a significant physical distance between the LED and lens and no reflector shaping, unacceptable levels of glare are inevitable.

Evaluating glare in quantifiable terms can be difficult, but not impossible. It's not simply a measure of lux or foot-candles alone. Instead, one must measure light density over a given area, referred to luminance (how bright it appears to the human eye), which typically is measured in candelas per square meter (cd/m2) or nits. With sports lighting, lumen density per square inch can also be used to show relative glare factor. A common mistake in measuring LED Luminaire luminance is measuring the entire fixture. Luminance must be measured at the luminous opening, in other words at the smallest point (without any breaks) that emits light out of the fixture. If one were to measure the entire LED luminaire, it would not account for the "shards" of light emitted from each individual LED. The light emitted from individual LED luminaire designs is mare akin to a series of laser beams in contrast to the homogenous output of a traditional luminaire.

Many conventional LED sports lights utilize numerous small, plastic TIR lenses which condense and collimate light emitted by LEDs. In practice, such LEDs can produce over 1000 lumens each and can average a lumen density of 1275+ Lumens/sq. in. (with substantially higher peak lumen densities). Such concentrated, ultra-bright points inherently produce very noticeable glare.

SUMMARY OF THE INVENTION

The disclosure of the present invention includes light fixtures having variable LED array sizes to form different beam angles. These light fixtures are particularly suitable for sports/venue lights and are characterized by highly concentrated high power small LED light sources including small light sources of different size LED arrays which may include additional diffusion. The variable array sizes, using the same high power LEDs, such as 600 W, 800 W, 1500 W or higher, for example, will provide fixtures with variable beam angles. For the purpose of the present disclosure, "high power" shall mean approximately 250 Watts and above.

All LEDs are laid out precisely to maximize output. Beam angle is controlled through different LED layouts and by moving the board closer to or further away from the glass optic. An internal reflector helps shape individual beams so light exiting the aperture is even, completely eliminating the type of glare associated with multioptics design. A single glass anti-reflecting, plated glass optic helps shape the exiting light into a tight, continuous beam with no hotspots.

The LED array or board of the present disclosure is preferably mounted to a heat dissipating apparatus in a housing to provide active cooling and the LED and heat dissipating apparatus together forming an LED engine. A power supply unit may also be included in the housing.

When attached together, such as in electrical connection, and enclosed in the housing, the lens, LED engine and power supply unit function as an integrated self-contained lighting apparatus.

Light Shaping Diffusers are micro-structures pseudo-randomly embedded on a substrate (such as film). When applied to a lighting structure, the LSD can manipulate light by changing the direction of its energy. This allows our Light Shaping Diffusers to sharpen and shape a light beam to suit a particular purpose. LED LSD material is provided in a variety of circular and elliptical angles from 1° to 100° on thin film or preferably a rigid substrate such as the lens of the present disclosure.

The transmission efficiencies of LSD materials may range between 85-92% (depending on the angle) and preferably as high as 96%. The high-efficiency rating may be due to the diffractive microstructures. Smaller angle diffusers may have the highest transmission. The microstructures may be random and non-periodic, and therefore the LSD is not wavelength dependent and capable of working from 400 nm to 1500 nm. Light Shaping Diffusion eliminates hotspots and glare without a significant reduction in the amount of transmitted light, provided that the diffuser is placed a preselected distance from the LEDs/LED array.

The present disclosure also includes a lens which substantially dissipates light to reduce if not eliminate glare. The lens may be pressed, chemically etched (pickled), or sandblasted to become a micro-lens. In an alternate embodiment the lens may be a plastic material.

A further aspect of the present disclosure is the incorporation of a segmented reflector. The segmented reflector of the present disclosure may greatly reduce glare. In an embodiment, the single reflector may be segmented in its circumference or may be formed of multiple individual segments.

The foregoing has outlined in broad terms the more important features of the invention disclosed herein so that the detailed description that follows may be more clearly understood, and so that the contribution of the instant inventors to the art may be better appreciated. The instant invention is not limited in its application to the details of the construction and to the arrangements of the components set forth in the following description or illustrated in the drawings. Rather the invention is capable of other embodiments and of being practiced and carried out in various other ways not specifically enumerated herein. Additionally, the disclosure that follows is intended to apply to all alternatives, modifications and equivalents as may be included within the spirit and the scope of the invention as defined by the appended claims. Further, it should be understood that the phraseology and terminology employed herein are for the purpose of description and should not be regarded as limiting, unless the specification specifically so limits the invention.

DETAILED DESCRIPTION OF THE PREFERRED EMBODIMENTS

The embodiments herein and the various features and advantageous details thereof are explained more fully with reference to the non-limiting embodiments that are illustrated in the accompanying drawings and detailed in the following description. Descriptions of well-known components and processes and manufacturing techniques are omitted so as to not unnecessarily obscure the embodiments herein. The examples used herein are intended merely to facilitate an understanding of ways in which the invention herein may be practiced and to further enable those of skill in the art to practice the embodiments herein. Accordingly, the examples should not be construed as limiting the scope of the claimed invention.

The disclosure of the present invention includes light fixtures having variable LED array sizes to form different beam angles. These light fixtures are particularly suitable for sports/venue lights and are characterized by highly concentrated small light sources including small light sources of different size LED arrays which may include additional diffusion. The variable array sizes, using the same high power LEDs, such as 800 W as a non-limiting example, will provide fixtures with variable beam angles.

A preferred embodiment light fixture of the present disclosure as depicted in the figures. The preferred light fixtures of the present disclosure are preferably NEMA 2-NEMA 6 with a single reflector. They may be mono-color but may also be bi-color, such as 600/800 bi-color. These fixtures may include active cooling.

Figure 1:
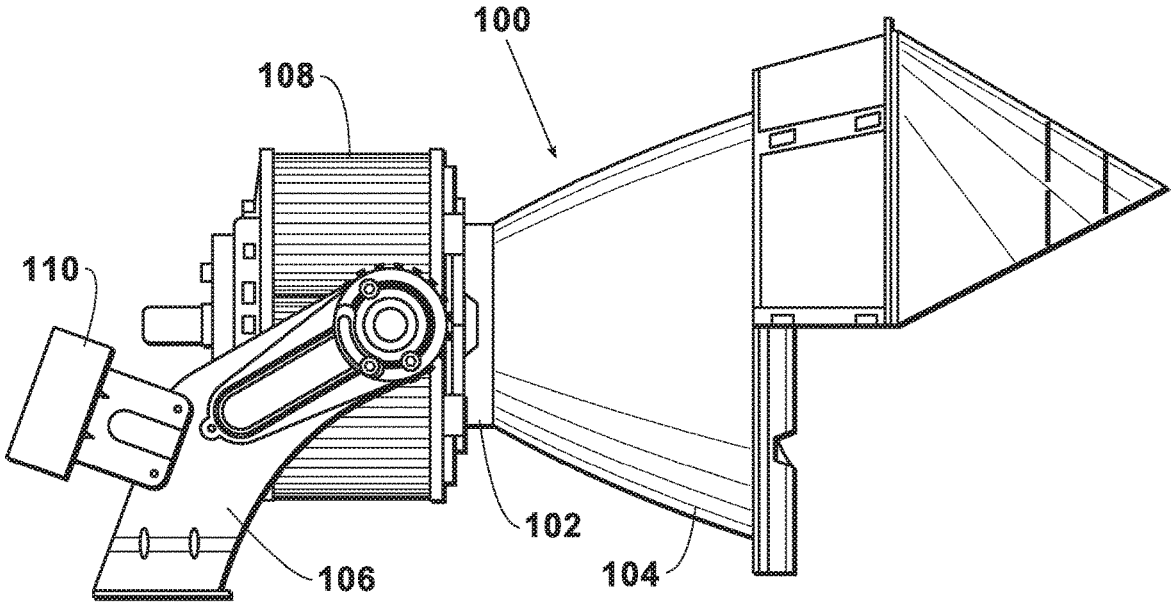
FIG. 1 is a first side view of an LED lighting fixture of the present disclosure.
Figure 2:
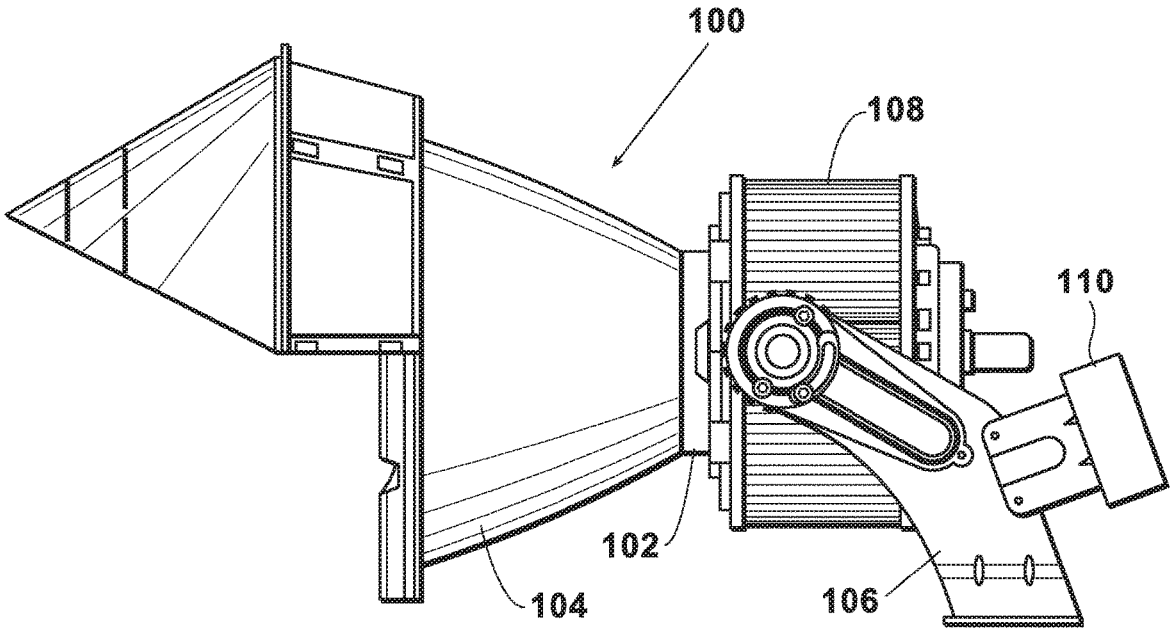
FIG. 2 is a second side view of an LED lighting fixture of the present disclosure.
Figure 3:
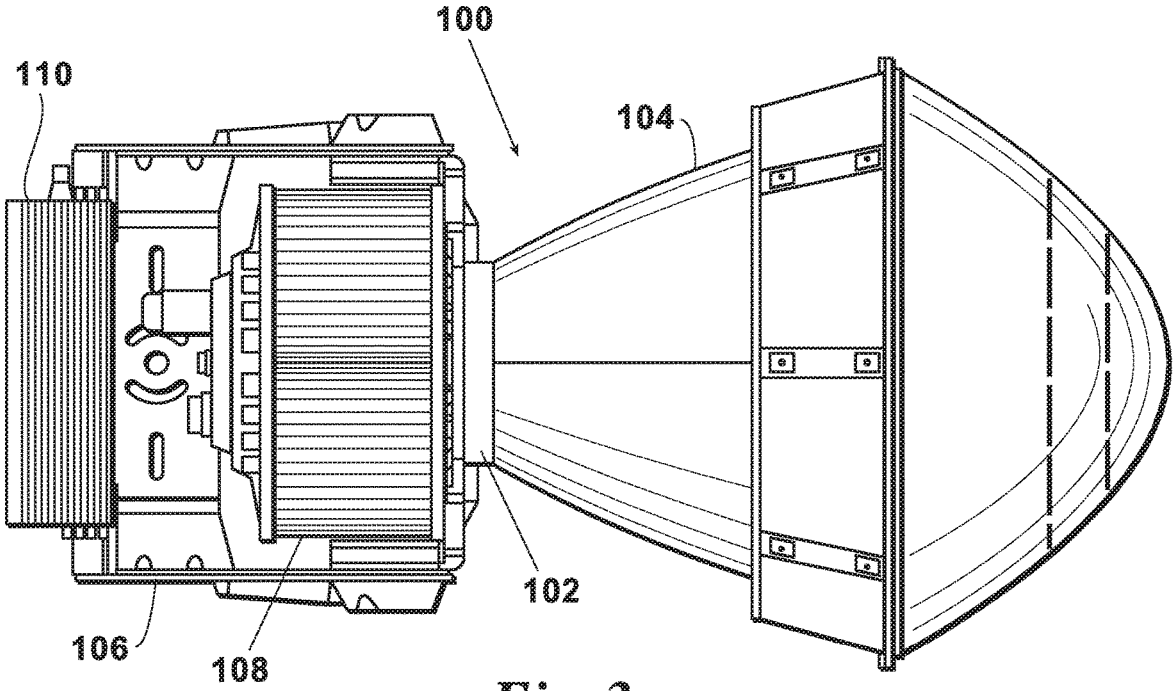
FIG. 3 is a top plan view of an LED lighting fixture of the present disclosure.
Figure 4:
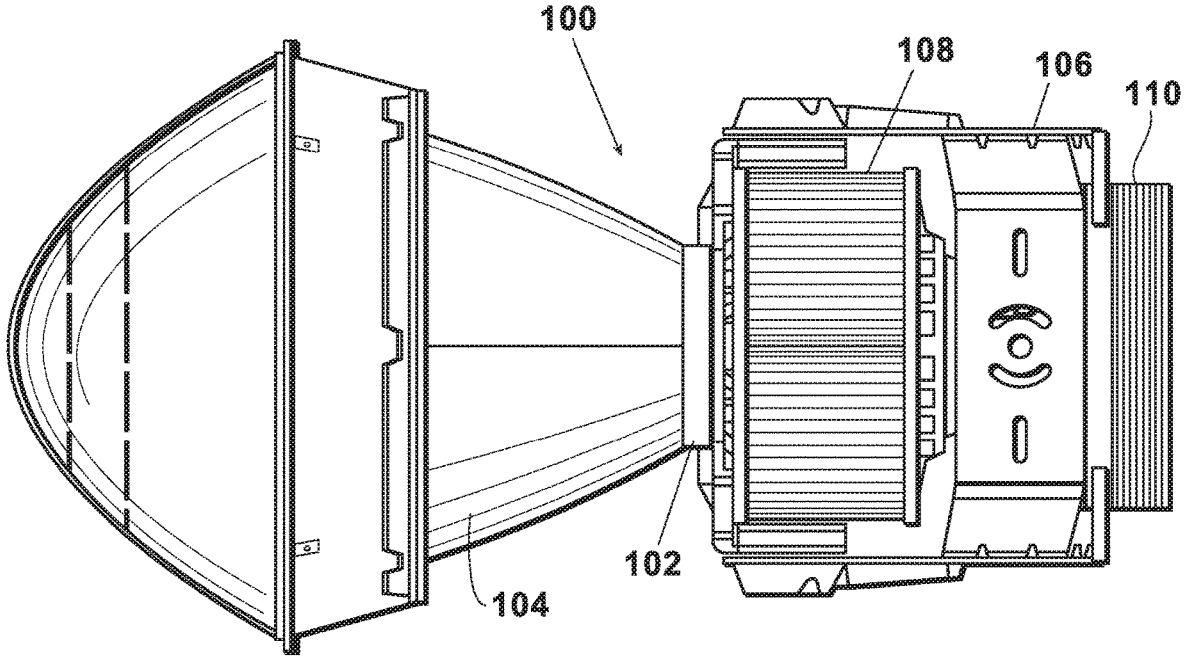
FIG. 4 is a bottom view of an LED lighting fixture of the present disclosure.
Figure 5:
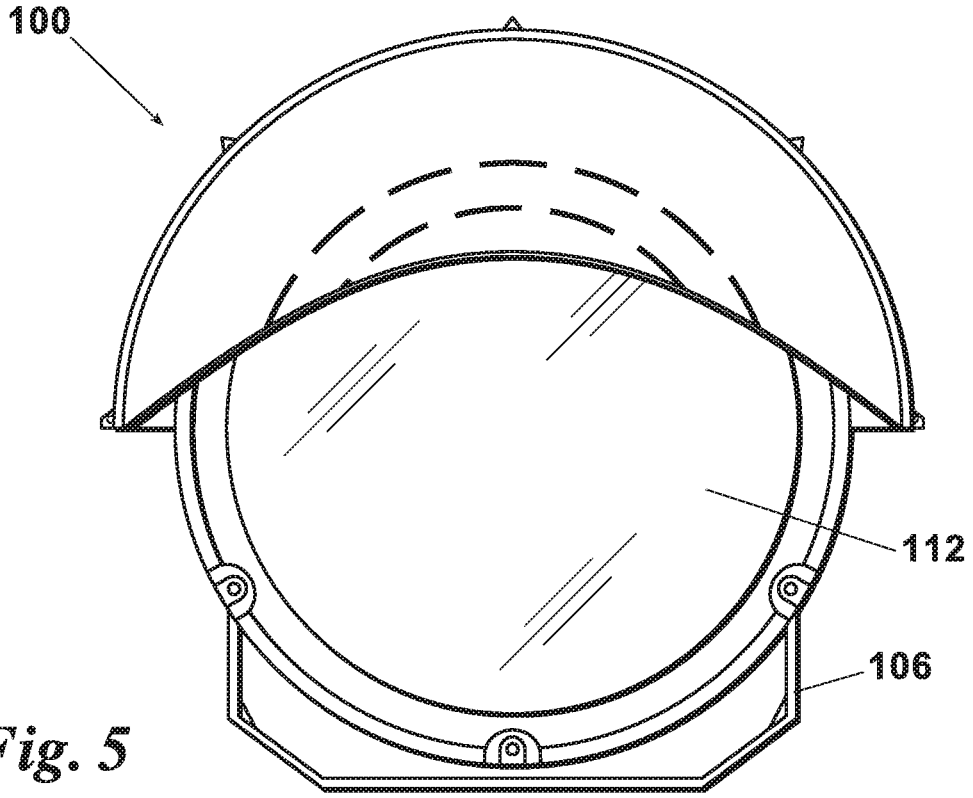
FIG. 5 is a front view of an LED lighting fixture of the present disclosure depicting a single optic.
Figure 6:
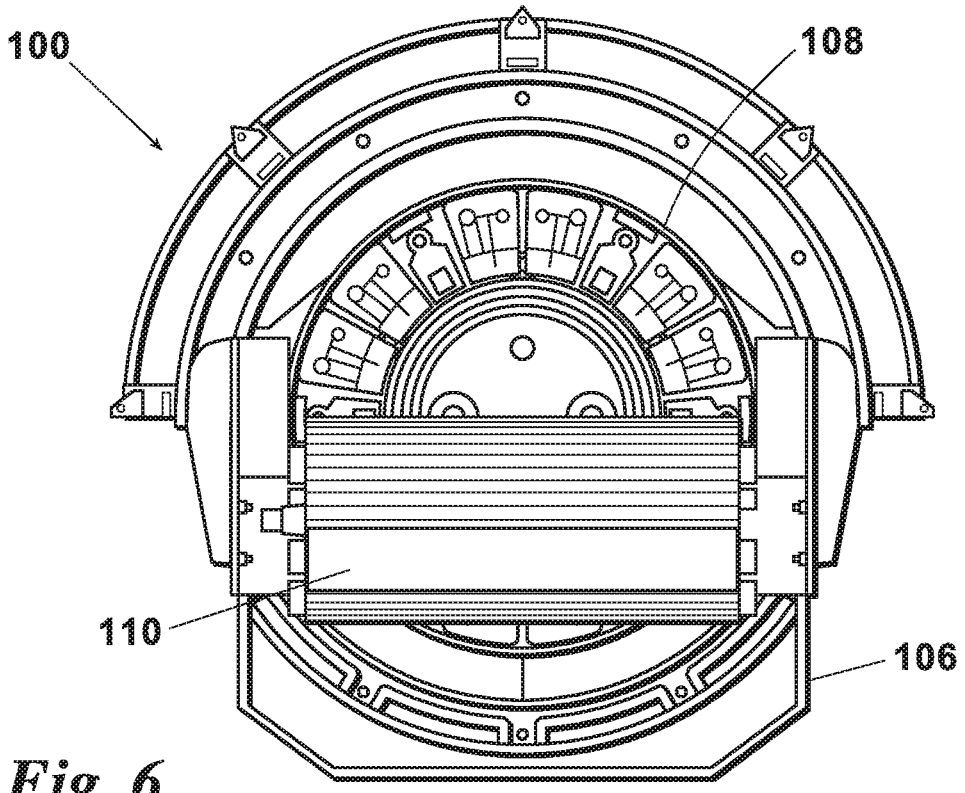
FIG. 6 is a back view of an LED lighting fixture of the present disclosure.

With reference to FIG. 106, LED light fixtures 100 for use in sports venue/stadium lighting generally have an LED array 102 which is surrounded with a reflector 104. The fixture 100 is usually constructed of many pieces, the base 106 generally serves as a frame which connects everything together. The base 106 is typically connected to a yoke or primary support. High power LED arrays require cooling so a heatsink 108, usually one of the heaviest components, is also connected to the base 106. The reflector housing 104 is also connected to the base and typically a gasket is inserted between them to provide a weatherproof seal. A power supply 110 is connected to the base and in electrical communication with the LED printed circuit board (PCB) 102 which may reside against the heatsink 108 but inside the reflector housing 104. The reflector housing 104 may have a separate reflector on the inside, or the inside of the reflector housing might have a polished surface. The reflector housing's 104 large open end is then covered by a transparent window or lens 112 (FIG. 5), typically a piece of glass that has a gasket which finishes the sealing of the reflector housing and the LEDs inside.

Eliminating glare is accomplished in the design of the present disclosure by incorporating a broad, single 27" glass lens 112 to provide a much more uniform lumen density of 346 lumens/sq. in. This design distributes light evenly over 50,000× the area of each individual LED light source, maximizing both the emitting area of luminaries and uniformly redistributing the originating ultra-bright points of LEDs. This greatly reduces the amount of glare.

The light fixtures of the present disclosure may also include diffusion. This may be true diffusion as known in the art. It is also contemplated to use Light Shaping Diffusion (LSD). Light shaping diffusion (LSD) may be included on or in the housing. A common issue with LED fixtures for venue lighting is that they may include aberrations at the edges of the projected beam. The light shaping diffusion (LSD) disclosed herein may be employed to accurately spread the light and to erase aberrations (chromatic or otherwise) introduced by the lens. In addition to correcting aberration, LSD will also integrate the light of the many LED elements ("hot spots" caused by multiple light sources projected from the light array) so they will project as an even (uniform) beam.

LSD material is commercially available and typically printed in predetermined directions, or even patterns, so that the present fixture may be capable of projecting light at preselected beam angles (such as a 16:9 ratio, for example) as may be desired. In a preferred arrangement a 2 degree. to 40 degree. LSD, or any range in between, is acceptable with 5 degree. to 10 degree. LSD being a preferable range, and 5.degree. LSD being particularly suitable. It is contemplated that the LSD in the present disclosure could either be a separate lens or, in alternative embodiments, the LSD could be cast or molded into, or printed onto the back side of the lens.

Suitable Light Shaping Diffusers are available commercially from sources such as Luminit LLC, located at 1850 W. 205th St. Torrance, Calif. 90501. The Luminit LSD is available in circular and elliptical diffusion angles as high as 80 degrees. Rated for high damage threshold and high-temperature applications, this glass diffuser can be designed directly into lighting systems to provide precise viewing angles with high transmission efficiencies. The Luminit high temperature light shaping diffusers use a holographically recorded, randomized surface relief structure that is replicated in a layer on the surface of a UV silica or B270 substrate. The precise surface relief structures of these glass-on-glass VCSEL diffusers provide high transmission efficiency (up to 92%) and controlled beam angle divergence while providing high quality homogenized light. Exemplary Luminit LSD is characterized by the following Table 1:

TABLE 1

| | Angles (FWHM) | Temp. | Substrate | Size | Refractive Index | Laser Damage Threshold |
|---|---|---|---|---|---|---|
| Pure | 0.5°-12° Circular | 500° C. | Fused Silica | Up to 4-in. Diameter | 1.46 | 8 J/cm$^2$ |
| Hybrid1 | 0.5°-50° Circular | 275° C. | Fused Silica | Up to 4-in. Diameter | 1.46 | 2.6 J/cm$^2$ |
| Hybrid2 | 0.5°-60° Circular & Elliptical | 150° C. | B270 | Up to 8-in. × 8-in. Diameter | 1.51 | N/A |

The present disclosure also includes a lens which substantially dissipates light to reduce if not eliminate glare. A lens of the present construction/chemistry may provide in the range of 96% transmission efficiency, with 2% loss per side of the glass. A lens having the following chemistry is described in one preferred embodiment:

TABLE 2

Material Composition.
Products/Raw Materials: Ultra clear glass
CONTENT (WT %):

| | Test material | | | | | |
|---|---|---|---|---|---|---|
| | $SiO_2$ | $Al_2O_3$ | CaO | MgO | NaO + $K_2O$ | $SO_3$ |
| tempered glass | 72.20% | 1.00% | 8.50% | 4.00% | 14.00% | 0.30% |

The lens may be pressed in a first embodiment. In alternate embodiments, the lens is chemically etched (pickled) using a chemical process to become a micro-lens. Alternatively, or in addition, the lens may be etched by sand blasting. As a result, a micro lens is produced which:

1. Hides LED array.
2. Mixes light at aperture

In an alternate embodiment the lens may be a plastic material. This embodiment is contemplated for indoor use mainly (although not required) since plastic tends to degrade upon extended exposure to sunlight.

A further aspect of the present disclosure is the incorporation of a segmented reflector. It has been determined that the segmented reflector of the present disclosure greatly reduces glare. In an embodiment, the single reflector may be segmented in its circumference. Embodiments thereof are depicted in the figures and the Attachments hereto, incorporated fully herein by reference, In one example, without limitation, an 800 W fixture may include 26-30 separate segments.

Figure 7:
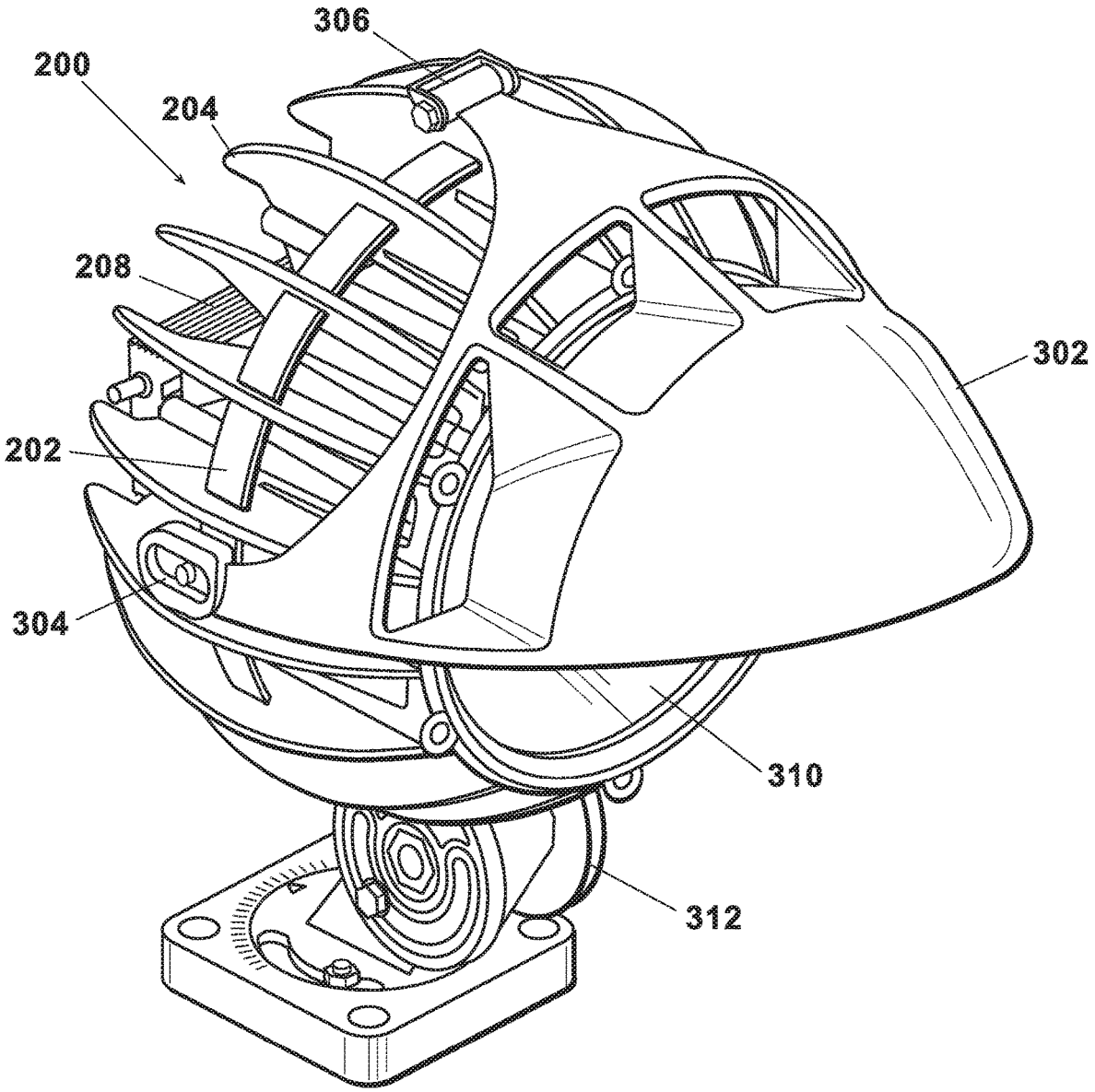
FIG. 7 is alternate embodiment of an LED lighting fixture of the present disclosure.
Figure 8:
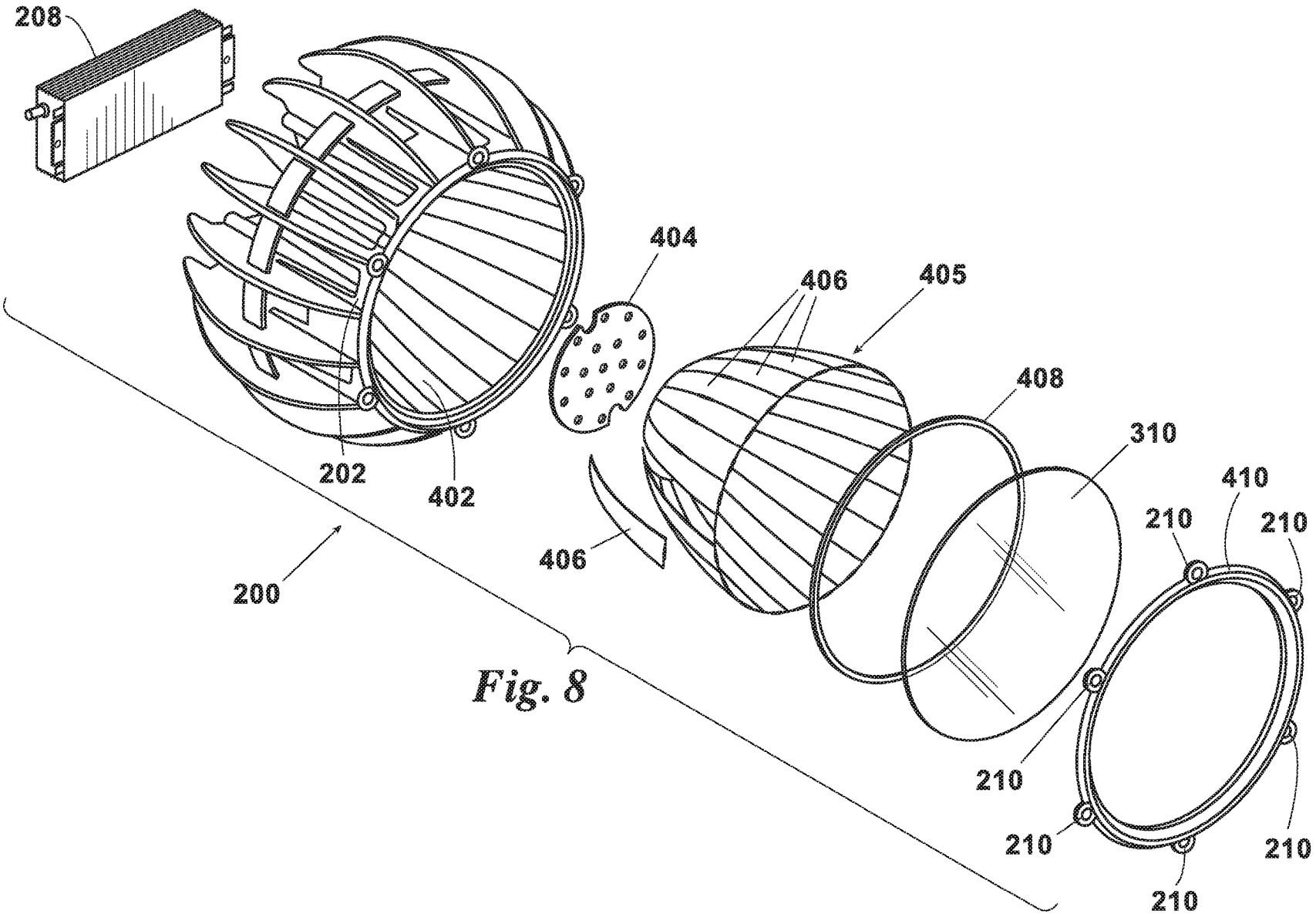
FIG. 8 is an exploded view of the LED lighting fixture of FIG. 7 depicting a segmented reflector.

With reference to FIGS. 7 and 8, a lighting fixture including a segmented reflector shall next be described. Referring now to FIG. 7, which is an exemplary single piece bodied light fixture 200 fitted with a visor. In this embodiment, the visor 302 has mounting points 304-308 (308 not shown) that mount to the single piece body 202 without connecting to the lens 310 area. The bottom knuckle mount 312 is also well out of the way of the visor 302 and the power supply 208 which is mounted to the rear of the single piece body 202.

Referring now to FIG. 8, an exploded view of the single piece bodied sports light fixture 200 of FIG. 7. In this exploded view, the front of the body 202 is where the internal reflector housing or cavity 402 receives the LED printed circuit board 404 which is attached by machine screws in the preferred embodiment. A reflector 405 including reflector segments 406 is inserted around the interior periphery of cavity 402 Segments 406 could either be connected together to form a unitary reflector 405 or be individual segments each secured in and around the interior periphery of cavity 402. A lens gasket 408 is placed on the very front of the single piece body 202 and then the lens 310 is placed against the gasket 408 with a lens retaining ring 410 being applied last. The lens retaining ring 410 is attached to the single piece body 202 at points 210 in any suitable manner, such as with fasteners such as bolts or clamps 212.

The foregoing has outlined in broad terms the more important features of the invention disclosed herein so that the detailed description that follows may be more clearly understood, and so that the contribution of the instant inventors to the art may be better appreciated. The instant invention is not limited in its application to the details of the construction and to the arrangements of the components set forth in the following description or illustrated in the drawings. Rather the invention is capable of other embodiments and of being practiced and carried out in various other ways not specifically enumerated herein. Additionally, the disclosure that follows is intended to apply to all alternatives, modifications and equivalents as may be included within the spirit and the scope of the invention as defined by the appended claims. Further, it should be understood that the phraseology and terminology employed herein are for the purpose of description and should not be regarded as limiting, unless the specification specifically so limits the invention.

The embodiments herein and the various features and advantageous details thereof are explained more fully with reference to the non-limiting embodiments that are illustrated in the accompanying drawings and detailed in the following description. Descriptions of well-known components and processes and manufacturing techniques are omitted so as to not unnecessarily obscure the embodiments herein. The examples used herein are intended merely to facilitate an understanding of ways in which the invention herein may be practiced and to further enable those of skill in the art to practice the embodiments herein. Accordingly, the examples should not be construed as limiting the scope of the claimed invention.

It is to be understood that the terms "including", "comprising", "consisting" and grammatical variants thereof do not preclude the addition of one or more components, features, steps, or integers or groups thereof and that the terms are to be construed as specifying components, features, steps or integers.

If the specification or claims refer to "an additional" element, that does not preclude there being more than one of the additional element.

It is to be understood that where the claims or specification refer to "a" or "an" element, such reference is not be construed that there is only one of that element.

It is to be understood that where the specification states that a component, feature, structure, or characteristic "may", "might", "can" or "could" be included, that particular component, feature, structure, or characteristic is not required to be included.

Where applicable, although state diagrams, flow diagrams or both may be used to describe embodiments, the invention is not limited to those diagrams or to the corresponding descriptions. For example, flow need not move through each illustrated box or state, or in exactly the same order as illustrated and described.

Methods of the present invention may be implemented by performing or completing manually, automatically, or a combination thereof, selected steps or tasks.

The term "method" may refer to manners, means, techniques and procedures for accomplishing a given task including, but not limited to, those manners, means, techniques and procedures either known to, or readily developed from known manners, means, techniques and procedures by practitioners of the art to which the invention belongs.

The term "at least" followed by a number is used herein to denote the start of a range beginning with that number (which may be a ranger having an upper limit or no upper limit, depending on the variable being defined). For example, "at least 1" means 1 or more than 1. The term "at most" followed by a number is used herein to denote the end of a range ending with that number (which may be a range having 1 or 0 as its lower limit, or a range having no lower limit, depending upon the variable being defined). For example, "at most 4" means 4 or less than 4, and "at most 40%" means 40% or less than 40%. Terms of approximation (e.g., "about", "substantially", "approximately", etc.) should be interpreted according to their ordinary and customary meanings as used in the associated art unless indicated otherwise. Absent a specific definition and absent ordinary and customary usage in the associated art, such terms should be interpreted to be ±10% of the base value.

When, in this document, a range is given as "(a first number) to (a second number)" or "(a first number)-(a second number)", this means a range whose lower limit is the first number and whose upper limit is the second number. For example, 25 to 100 should be interpreted to mean a range whose lower limit is 25 and whose upper limit is 100. Additionally, it should be noted that where a range is given, every possible subrange or interval within that range is also specifically intended unless the context indicates to the contrary. For example, if the specification indicates a range of 25 to 100 such range is also intended to include subranges such as 26-100, 27-100, etc., 25-99, 25-98, etc., as well as any other possible combination of lower and upper values within the stated range, e.g., 33-47, 60-97, 41-45, 28-96, etc. Note that integer range values have been used in this paragraph for purposes of illustration only and decimal and fractional values (e.g., 46.7-91.3) should also be understood to be intended as possible subrange endpoints unless specifically excluded.

It should be noted that where reference is made herein to a method comprising two or more defined steps, the defined steps can be carried out in any order or simultaneously (except where context excludes that possibility), and the method can also include one or more other steps which are carried out before any of the defined steps, between two of the defined steps, or after all of the defined steps (except where context excludes that possibility).

Thus, the present invention is well adapted to carry out the objects and attain the ends and advantages mentioned above as well as those inherent therein. While presently preferred embodiments have been described for purposes of this disclosure, numerous changes and modifications will be apparent to those skilled in the art. Such changes and modifications are encompassed within the spirit of this invention as defined by the appended claims.

What is claimed is:

1. A venue light, comprising:

a single body including an interior cavity with a front open to said interior cavity;

an LED printed circuit board attached to said body within said interior cavity;

said LED printed circuit board including an LED array adapted to project light;

a plurality of reflector segments secured in said interior cavity of said body to form a reflector such that said reflector surrounds said LED array;

each of said plurality of reflector segments adapted to reflect and direct said light projected by said LED array from said interior cavity through said open front of said body;

a lens secured to said body to cover said open front;

light shaping diffusion applied to said lens.

2. The venue light of claim 1 wherein said lens includes a chemical composition selected from a group consisting of: $SiO_2$, $Al_2O_3$, CaO, MgO, $NaO+K_2O$, and $SO_3$.

3. The venue light of claim 1 wherein said lens includes a chemical composition selected from a group consisting of 72.20% $SiO_2$, 1.00% $Al_2O_3$, 8.5% CaO, 4.00% MgO, 14.00% $NaO+K_2O$, and 0.3% $SO_3$.

4. The venue light of claim 1 wherein said lens is open front of said body is circular and said lens is circular.

5. The venue light of claim 1 wherein said light shaping diffusion is fused silica.

6. The venue light of claim 1 wherein said light shaping diffusion is B270.

7. The venue light of claim 1 wherein said lens is etched to become a micro lens.

8. The venue light of claim 1 wherein a gasket is placed between said lens and said body to seal said internal cavity.

9. The venue light of claim 8 wherein a lens retaining ring secures said lens to said body.

10. The venue light of claim 1 including a visor secured to said body such that said visor at least partially surrounds said lens.

* * * * *